US008752632B2

(12) United States Patent
Agerbæk

(10) Patent No.: US 8,752,632 B2
(45) Date of Patent: Jun. 17, 2014

(54) ASSEMBLY FOR USE IN A CHRISTMAS TREE

(75) Inventor: Martin Kaster Agerbæk, Bramming (DK)

(73) Assignee: Maersk Olie OG Gas A/S, Copenhagen K (DK)

( * ) Notice: Subject to any disclaimer, the term of this patent is extended or adjusted under 35 U.S.C. 154(b) by 183 days.

(21) Appl. No.: 12/995,972

(22) PCT Filed: May 27, 2009

(86) PCT No.: PCT/EP2009/056448

§ 371 (c)(1), (2), (4) Date: Feb. 28, 2011

(87) PCT Pub. No.: WO2009/147040

PCT Pub. Date: Dec. 10, 2009

(65) Prior Publication Data

US 2011/0139461 A1 Jun. 16, 2011

Related U.S. Application Data

(60) Provisional application No. 61/058,065, filed on Jun. 2, 2008.

(30) Foreign Application Priority Data

Jun. 2, 2008 (DK) ..... 2008 00749

(51) Int. Cl.
*E21B 7/12* (2006.01)

(52) U.S. Cl.
USPC ..... 166/344; 166/338; 166/347; 166/360

(58) Field of Classification Search
USPC ..... 166/338, 344, 347, 348, 360, 368, 85.1, 166/88.1
See application file for complete search history.

(56) References Cited

U.S. PATENT DOCUMENTS 2,632,513 A 3/1953 Bennett
3,722,585 A * 3/1973 Nelson et al. ..... 166/339

(Continued)

FOREIGN PATENT DOCUMENTS

WO 0181710 A1 11/2001

OTHER PUBLICATIONS

International Search Report PCT Application No. PCT/EP2009/056448, 4 pages, Jan. 29, 2010.

(Continued)

*Primary Examiner* — Matthew Buck
*Assistant Examiner* — Aaron Lembo
(74) *Attorney, Agent, or Firm* — Brinks Gilson & Lione

(57) ABSTRACT

The assembly comprises a housing (1) having a first end having an inlet channel and a second end having an outlet channel, said channels being connected by a central passage (3), said housing further comprising a side-entry bore (2) providing communication between said central passage and the external of said housing, the assembly also comprising a hanger positioned below said side-entry bore, supporting a coiled tubing and provided with a first passage communicating with said coiled tubing and a second separate fluid passage communicating with the annulus surrounding said coiled tubing. Furthermore the assembly comprises an upper assembly to be inserted through the side-entry bore and a stinger (50), said stinger connecting said hanger and said upper assembly, wherein said first passage is extended through the stinger and said second fluid passage is extended by the annulus between said stinger and said hanger, the upper assembly and the upper section of the stinger extending said first passage to the external of said housing and said second passage to the second end of the housing.

18 Claims, 10 Drawing Sheets

(56) References Cited

U.S. PATENT DOCUMENTS

| | | | | |
|---|---|---|---|---|
| 3,965,987 | A * | 6/1976 | Biffle | 166/379 |
| 4,382,717 | A * | 5/1983 | Morrill | 405/169 |
| 4,457,378 | A * | 7/1984 | Watkins | 166/347 |
| 4,513,823 | A * | 4/1985 | Hynes et al. | 166/386 |
| 4,568,058 | A * | 2/1986 | Shelton | 251/62 |
| 4,629,003 | A * | 12/1986 | Baugh | 166/341 |
| 4,958,686 | A * | 9/1990 | Putch | 166/348 |
| 5,203,409 | A * | 4/1993 | Seid et al. | 166/95.1 |
| 5,337,828 | A | 8/1994 | Jennings, Jr. | |
| 5,971,077 | A * | 10/1999 | Lilley | 166/368 |
| 6,053,252 | A * | 4/2000 | Edwards | 166/348 |
| 6,227,300 | B1 * | 5/2001 | Cunningham et al. | 166/339 |
| 6,357,529 | B1 * | 3/2002 | Kent et al. | 166/344 |
| 6,367,551 | B1 * | 4/2002 | Fenton | 166/345 |
| 6,408,947 | B1 * | 6/2002 | Cunningham et al. | 166/339 |
| 6,612,368 | B2 * | 9/2003 | Kent et al. | 166/75.13 |
| 6,729,392 | B2 * | 5/2004 | DeBerry et al. | 166/75.14 |
| 6,763,891 | B2 * | 7/2004 | Humphrey et al. | 166/368 |
| 6,796,381 | B2 * | 9/2004 | Ayler et al. | 166/387 |
| 6,810,954 | B2 * | 11/2004 | Garrett et al. | 166/77.51 |
| 6,920,925 | B2 * | 7/2005 | Duhn et al. | 166/75.13 |
| 7,165,620 | B2 * | 1/2007 | Steedman | 166/368 |
| 7,201,229 | B2 * | 4/2007 | White et al. | 166/368 |
| 7,331,396 | B2 * | 2/2008 | Reimert et al. | 166/368 |
| 7,699,099 | B2 * | 4/2010 | Bolding et al. | 166/89.1 |
| 7,699,110 | B2 * | 4/2010 | Anderson et al. | 166/368 |
| 7,726,405 | B2 * | 6/2010 | McMiles | 166/344 |
| 7,770,649 | B2 * | 8/2010 | Biester et al. | 166/338 |
| 7,913,754 | B2 * | 3/2011 | Bolding | 166/90.1 |
| 7,934,550 | B2 * | 5/2011 | Bolding et al. | 166/263 |
| 8,066,063 | B2 * | 11/2011 | Donald et al. | 166/88.4 |
| 8,151,890 | B2 * | 4/2012 | Spencer et al. | 166/352 |
| 2001/0011592 | A1 * | 8/2001 | Baker | 166/339 |
| 2001/0045287 | A1 | 11/2001 | Brewer | |
| 2002/0070026 | A1 * | 6/2002 | Fenton et al. | 166/368 |
| 2003/0000693 | A1 * | 1/2003 | Couren et al. | 166/66 |
| 2003/0221823 | A1 * | 12/2003 | Duhn et al. | 166/85.4 |
| 2004/0074635 | A1 * | 4/2004 | Collie et al. | 166/85.1 |
| 2006/0169459 | A1 * | 8/2006 | Smith et al. | 166/372 |
| 2007/0187114 | A1 * | 8/2007 | Smith et al. | 166/380 |

OTHER PUBLICATIONS

Written Opinion of the International Searching Authority for PCT Application No. PCT/EP2009/056448, 5 pages, Dec. 2, 2010.

International Preliminary Report on Patentability issued in international application No. PCT/EP2009/056448, dated Dec. 6, 2010 (6 pages).

* cited by examiner

ASSEMBLY FOR USE IN A CHRISTMAS TREE

This application is a filing under 35 U.S.C. §371 of International Patent Application PCT/EP2009/056448, filed May 27, 2009, which claims priority to Danish Application No. PA200800749, filed Jun. 2, 2008 and to U.S. Provisional Application No. 61/058,065, each of which is incorporated by reference herein in its entirety.

The invention relates to an assembly suitable for use with a Christmas tree used with coiled tubing and other wellhead components.

Coiled tubing gas lift is widely used in oil and gas production. The technology involves lowering of a coiled tubing string into the well. Gas is injected through the coiled tubing and into the oil stream at the bottom of the well to lift the oil to the surface. Oil and gas are traveling on the outside of the coiled tubing and flow to normal production facilities via a wellhead.

The wellhead is normally positioned at the top of the well. The wellhead terminates all the casings that are in the well and enables pressure monitoring and pumping into each casing annulus section. An assembly called an x-mas tree or a Christmas tree is located at the top of the wellhead.

The Christmas tree is the assembly of gate valves, chokes, and fittings that controls the flow of oil or gas during production. Tree design is based on e.g. the production pressure and/or flow rates. The x-mas tree and wellhead are usually made up and installed as a unit.

Valves located on the wellhead between the well head and the x-mas tree are called master valves. Christmas trees normally have at least one master valve; usually two are used. Having two master valves allow the use of the top master valve for normal use, thus reducing wear on the lower master valve which is the most difficult to replace.

Replacement of the top master valve can be accomplished relatively easily by isolating the upper portion of the tree with the lower master valve. However, replacement of the lower master valve is a complicated operation which involves plugging off the well.

In order not to block the master valves, coiled tubing gas lift operations involves, in known technique, that the coiled tubing must be terminated below the master valve.

Therefore coiled tubing gas lift operations normally involve removal of the lower master valve and installation of a special tool called a wellhead spool.

It is an object with the invention to provide a new assembly and to avoid the drawbacks involved with the known technique and to provide an alternative.

The object of the invention is achieved by said assembly comprising: a housing having an exterior surface, a first end having an inlet channel and a second end having an outlet channel, said inlet and outlet channels being connected by a central flow passage for providing fluid communication between a well and said Christmas tree, said first end being connectable to a well being positioned below said connector, said housing further comprising a side-entry bore for providing fluid communication between said central flow passage and the external of said housing; a hanger tool being positioned in a well tubular below said side entry bore and supporting a coiled tubing, said hanger tool being provided with two separate fluid passages: a first fluid passage communicating with said coiled tubing, and a second fluid passage communicating with the annulus between said coiled tubing and said well tubular; an upper assembly to be inserted through the side entry bore; a tubular stinger tool having an upper section and a lower section, the lower section having a portion adapted to be inserted into the hanger tool, and the upper section having a portion being adapted for connection with said upper assembly to be inserted through said housing; the hanger tool and the stinger tool being mutually adapted such that said first fluid passage is being extended through the stinger to the upper section of said tubular stinger and said second fluid passage is being extended by the annulus created between said tubular stinger tool and said hanger tool, the upper assembly and the upper section of the tubular stinger being mutually adapted such that said first fluid passage is being further extended to the external of said housing and said second fluid passage is being further extended to the second end of the housing.

Various other aspects of the invention are recited in the dependent claims.

The invention will be described in greater details with reference to the accompanying drawings, wherein FIG. 1 schematically illustrates a prior art x-mas tree comprising two master (2, 2*a*) valves;

It is common in the oilfield industry to insert a string of coil tubing into a wellbore. The coiled tubing may be used to solve a number of problems such as e.g. servicing. Coiled tubing may also be used to establish lift by injection of gas into the oil stream at the bottom of the well. Oil and gas are then traveling up the well on the outside of the coiled tubing and flows to normal production facilities.

Figure 1:
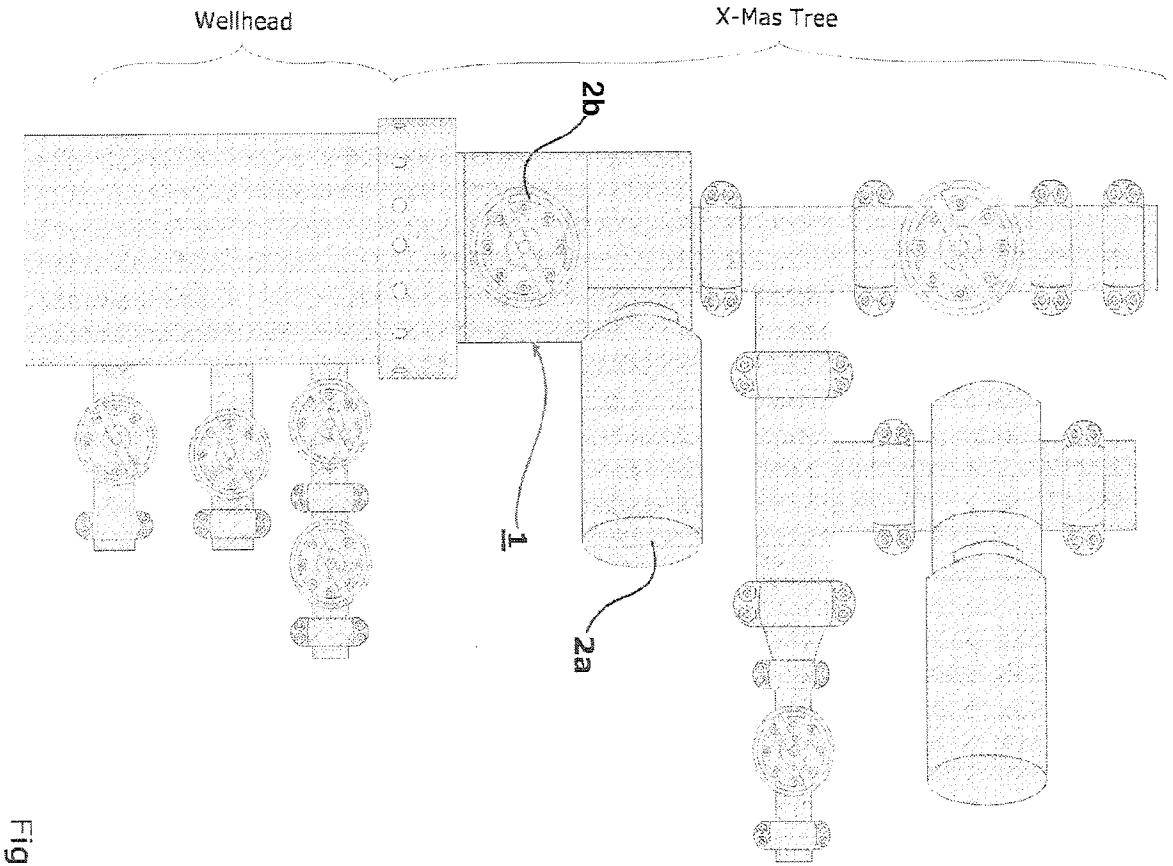

In FIG. 1 is shown a conventional well having a wellhead. On top of the wellhead is located in the shown embodiment a valve-tree called a Christmas tree.

The valves (2*b*, 2*a*) in the Christmas tree control the fluids from the oil well. In the Christmas tree there are normally two valves for closing off the well. However, Christmas trees may be equipped with only one master valve or even without master valves. Having two master valves allows the use of the top master valve for normal use, thus reducing wear on the lower master valve which is the most difficult to replace. In the shown embodiment the lower master (2*b*) valve is of the hydraulically operated type, while the upper master valve (1) is manually operated.

Replacement of the top master valve can be accomplished relatively easily by isolating the upper portion of the tree with the lower master valve. However, replacement of the lower master valve is a complicated operation which involves plugging off the well.

In order not to block the master valves, coiled tubing gas lift operations involve, in known technique, that the coiled tubing must be terminated below the master valve.

Therefore coiled tubing gas lift operations normally involve removal of the lower master valve housing, and since the weight of the master valves is high this normally involves dangerous crane operations which might interfere with well operations taking place in neighboring wells.

Other prior art methods involve adding a special tool called a spool between the wellhead and the Christmas tree in order to accommodate a hanger for the coiled tubing.

It is an object with the invention to provide a new assembly and to avoid the drawbacks involved with the known techniques.

It is another object of the invention to provide an assembly which can be utilized without removal of the lower master valve housing.

The functionality of a prior art master valve will now be described in greater details with reference to FIG. 6.

Figure 6:
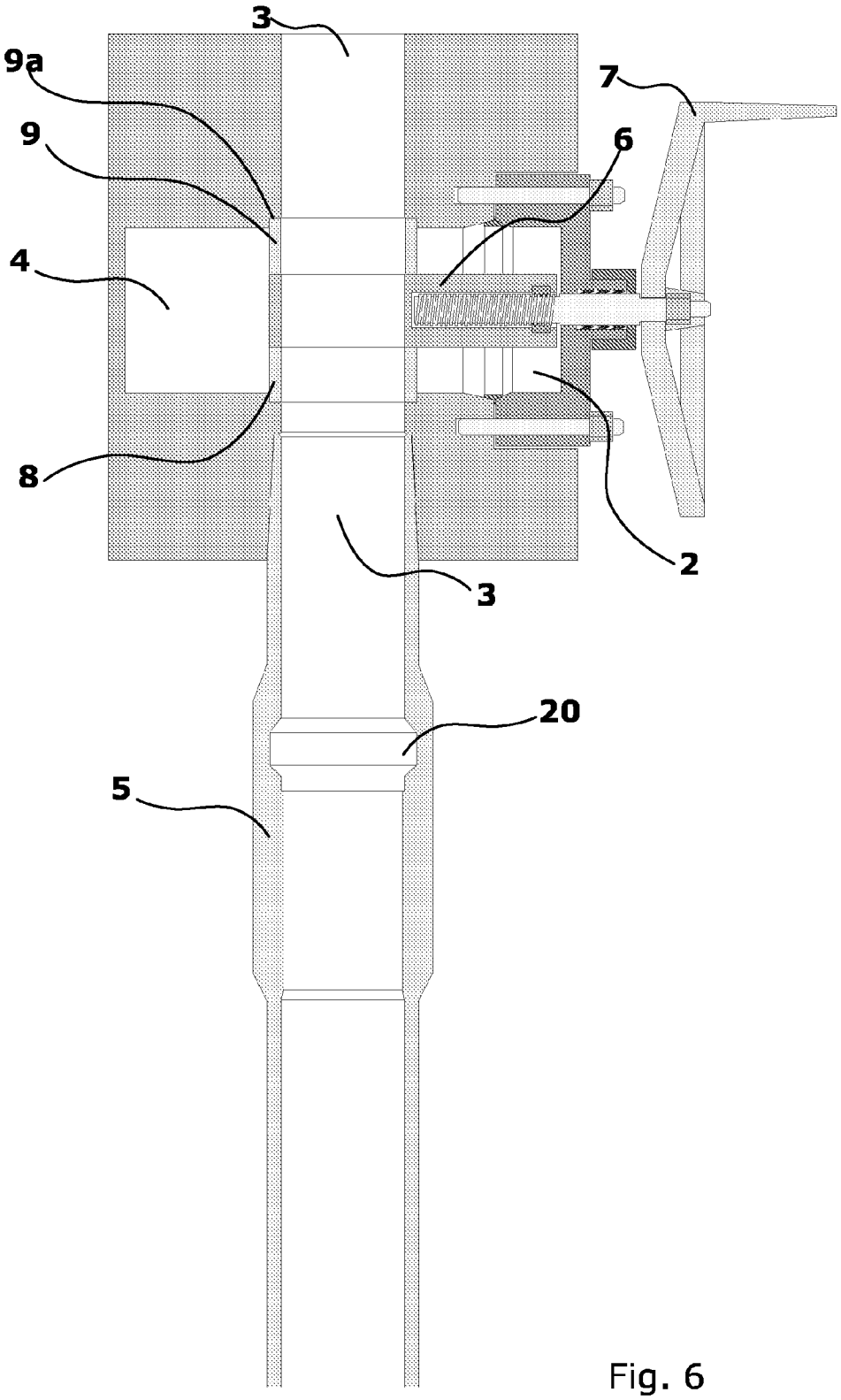
FIG. 6 is a schematic cross sectional view of master valve connected to a production tubing.

In FIG. 6 is shown a master valve connected to a production tubing (5) being equipped with an internal profile (20). Providing of the internal profile (20) enables fastening of equipment as a plug or other equipment as e.g. a back pressure valve for use during Christmas Tree repair.

The valves is in the shown embodiment a gate valve, but any other types of valves known to the skilled person might function as master valves.

A central flow passage (3) intersects a side entry bore (2), extending from the external surface of the valve housing to a cavity (4). A gate 6, having a hole (not shown) through, can move from the open position shown in FIG. 6 to a closed position where a solid part of the gate (6) (shown at right side in FIG. 6) blocks the central flow passage (3). When the valve is closed, the through-going hole extends into the cavity (4).

When the valve is fully open, it allows straight passage through the central fluid passage (3) having essentially the same size as the inside diameter of the production tubing (3). The internal parts of the valve are secured to the housing by partly bolts or screws and partly by seats (9) being inserted into recesses (9*a*) formed in the housing. The valve is, in the shown embodiment, operated by the hand wheel (7) but other types of actuation means known to the skilled man may be used (e.g. electric or hydraulic actuators).

Figure 3:
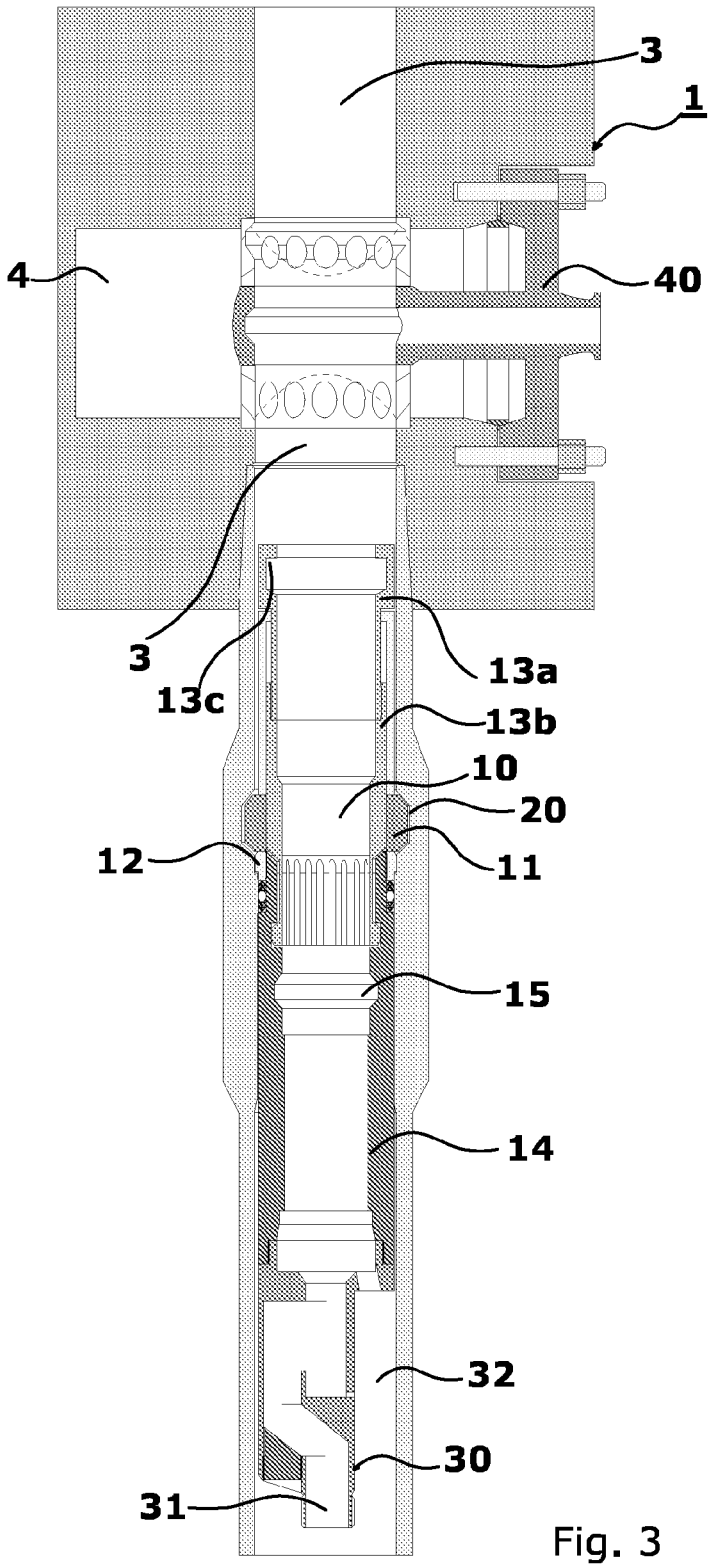
FIG. 3 is a schematic cross-sectional view of a housing with a tubular hanger inserted.

Turning now to FIG. 3, an embodiment of coiled tubing hanger tool will now be described.

The coiled tubing hanger tool, comprises in the shown embodiments, two main parts: a cross-over tool (30) to which the coiled tubing suspended (not shown) in the well is attached and a tubing hanger lock tool (12,13,14).

The tubing hanger lock tool (12, 13, 14) provides the necessary force to secure the coiled tubing hanger tool in the well. The principal components of the tubing hanger lock, shown in FIG. 3, are a so-called upper locking mandrel 12, an upper sub 13, a lock body 14 and locking dogs (11) which are capable of locking the tubing hanger lock assembly releasably in the hanger profile (20) in the production tubing. Tubing hanger locks like the one shown in FIG. 3 are well known to the person skilled in the art and their functionality will therefore not be described in greater details herein.

In the lowermost (towards the well) part of the tubing hanger lock tool (12,13,14) is the cross-over tool (30) and it is usually fastened to the tubing hanger (12,13,14) by threads (Screwed on to the bottom of the lock body (14) but other fastening means may be used.

The cross-over tool is provided with 2 separate channels (31 and 32) and the coiled tubing which is suspended in the well (not shown) is connected to the channel designated by reference numeral 31.

The other channel with reference numeral 32 is in fluid communication with the annulus surrounding the suspended coiled tubing (not shown)

Figure 2:
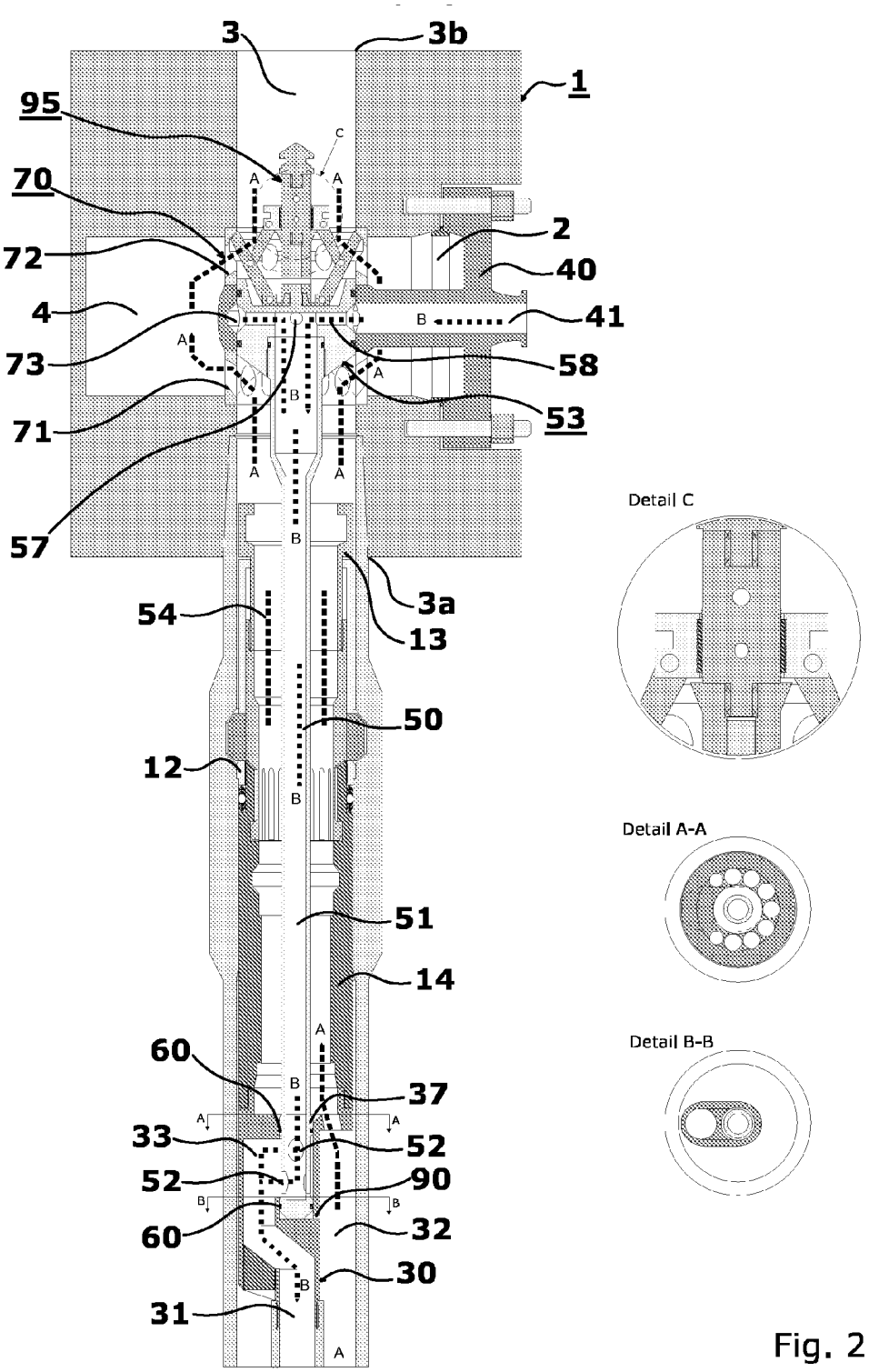
FIG. 2 shows a partial longitudinal section of the assembly inserted in a well tubular.

Turning now to FIG. 2 an embodiment of a stinger part according to the invention installed into the hanger tool is described.

In the shown embodiment a separate running tool known as a stinger tool (50) (or just stinger) is inserted into the hanger tool (12,13 14), and the lower part (towards the well) of the stinger tool (50) is connected to the cross-over tool (30). The lower part of the stinger tool (50) and the cross-over tool (30) are mutually adapted such that the stinger tool (50) can be inserted (slid) into a receptacle formed in the cross-over tool (30).

The stinger tool (50) is provided with a central, internal fluid channel (51), which communicates with one or more openings provided in the upper end and the lower end (52) of the stinger tool, respectively.

In one embodiment, the lower end of the stinger tool is provided with four holes (52).

The upper end of the stinger tool is, in the shown embodiment, threaded into a female threaded seal bore male part (53). The details and functionality of the seal bore male part (53) will be described in greater detail with reference to FIG. 4.

The stinger tool (50) has an outer cylindrical surface that has thereon a set of seal means (60) which cooperates with the receptacle in the cross-over tool such that seals are established on both sides of the openings (52) once the stinger is run into the cross-over tool (30). One or more pressure relief openings (90) provided in the cross-over tool enables insertion of the stinger tool into the cross-over tool. By preventing building up of pressure underneath the lowermost part of the stinger tool, these openings (90) also entail relief for the axial fixation of the stinger tool an thereby also reduce the forces acting on a locking mechanism (95) (shown in FIG. 2) which secures the assembly according to the invention in the housing.

Figure 4:
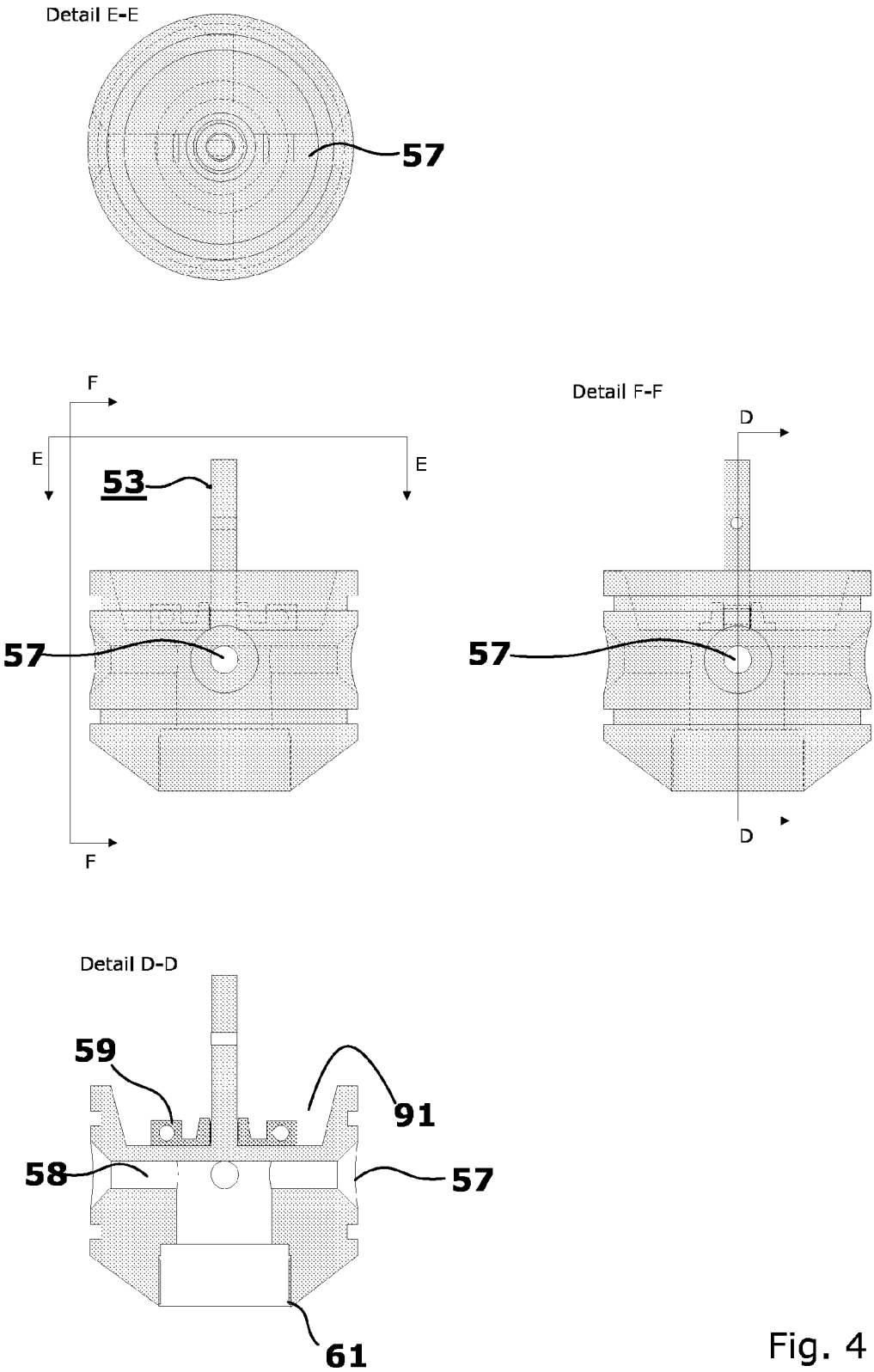
FIG. 4 is a schematic cross sectional view of a seal bore male part.

In FIG. 4 is shown a seal bore male part (53).

The seal bore male part (53) is equipped with one or more inlet ports (57) which are in fluid communication with one or more corresponding internal channels (58). The internal channel(s) (58) lead to a central opening (61) formed in the underside of the seal bore male part (53). The upper part of the stinger (50) and the central opening (61) are mutually adapted such that the upper part of the stinger can be connected (screwed) into the opening (61) and thereby establishes fluid communication between the internal channel (51) in the stinger and the inlet ports (57) formed in the seal bore male part (53) when connected. Alternatively, the seal bore male part (53) may be provided with a (male) part which can be connected into an opening formed in the stinger (50).

For providing a support for the locking mechanism (95) (shown in FIG. 2) the seal bore male part (53) is equipped with a recess (91) and an attachment part (59) formed in its upper side.

Figure 5:
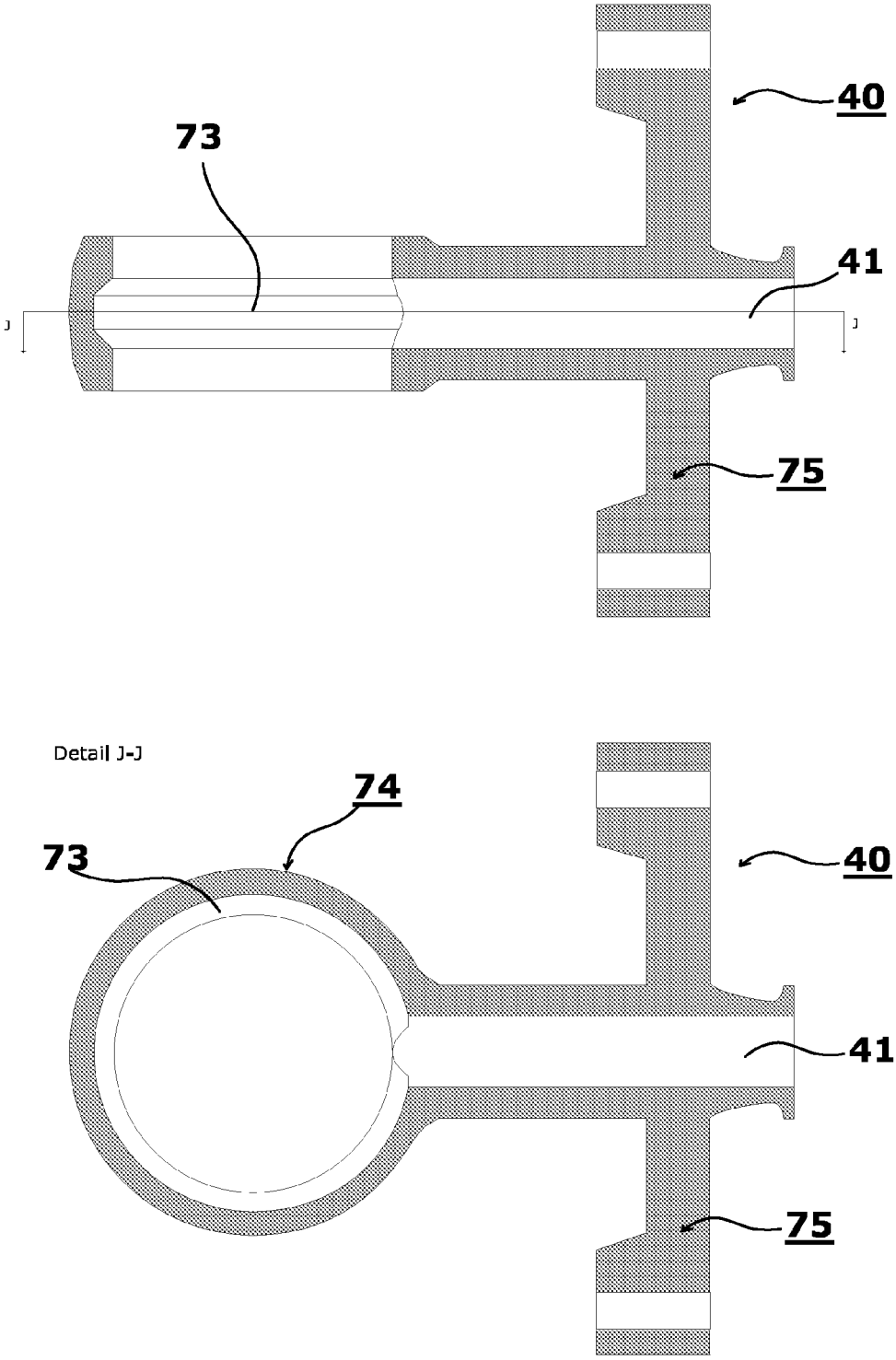
FIG. 5 is a schematic cross sectional view of an seal bore bonnet.

Turning now to FIG. 5 a seal bore bonnet (40) is shown.

The seal bore bonnet comprises two parts, one (75) for sealing of the side entry bore and a circular part (74) being for connection with the seal bore male part (53).

The circular part (74) is equipped with a circumferential void (73). The seal bore bonnet (40) and the seal bore male part (53) are provided with mutually adapted connecting means, and when connected as seen in e.g FIG. 2, fluid communication between the internal channel in the stinger (52) and the external of the housing is achieved by holes/opening/ports (57) leading from inside the stinger (50) to an intermediate channel (58) which is extends to a circumferential void (73) formed in the seal bore bonnet. From the void, the fluid connection further extends to the external surface of the housing by channel (41) running inside the seal bore bonnet (40).

The functionality of an embodiment of an assembly according to the invention will now be described with reference to FIGS. 5-8.

Figure 7:
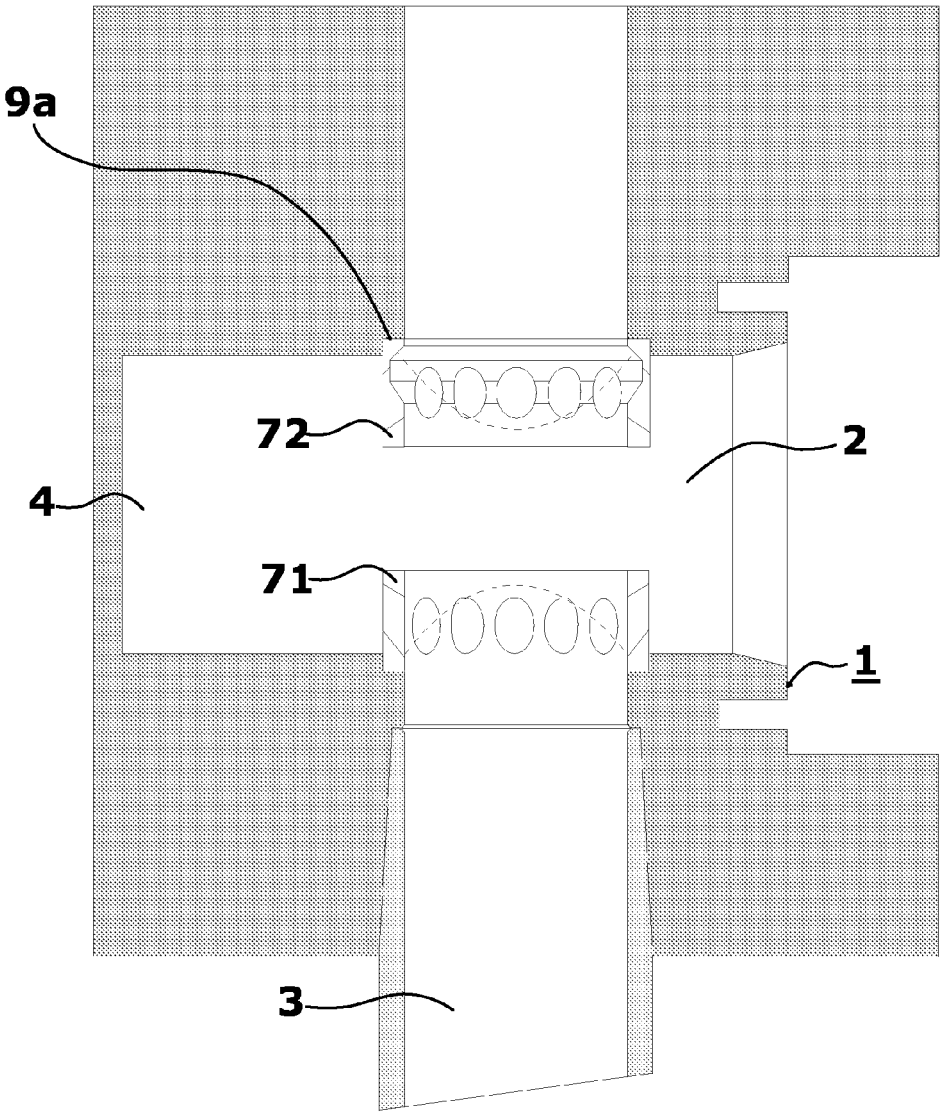
FIG. 7 is a schematic drawing of an embodiment of seat bore bonnets installed in a housing previously used for housing of a lower master valve.
Figure 8:
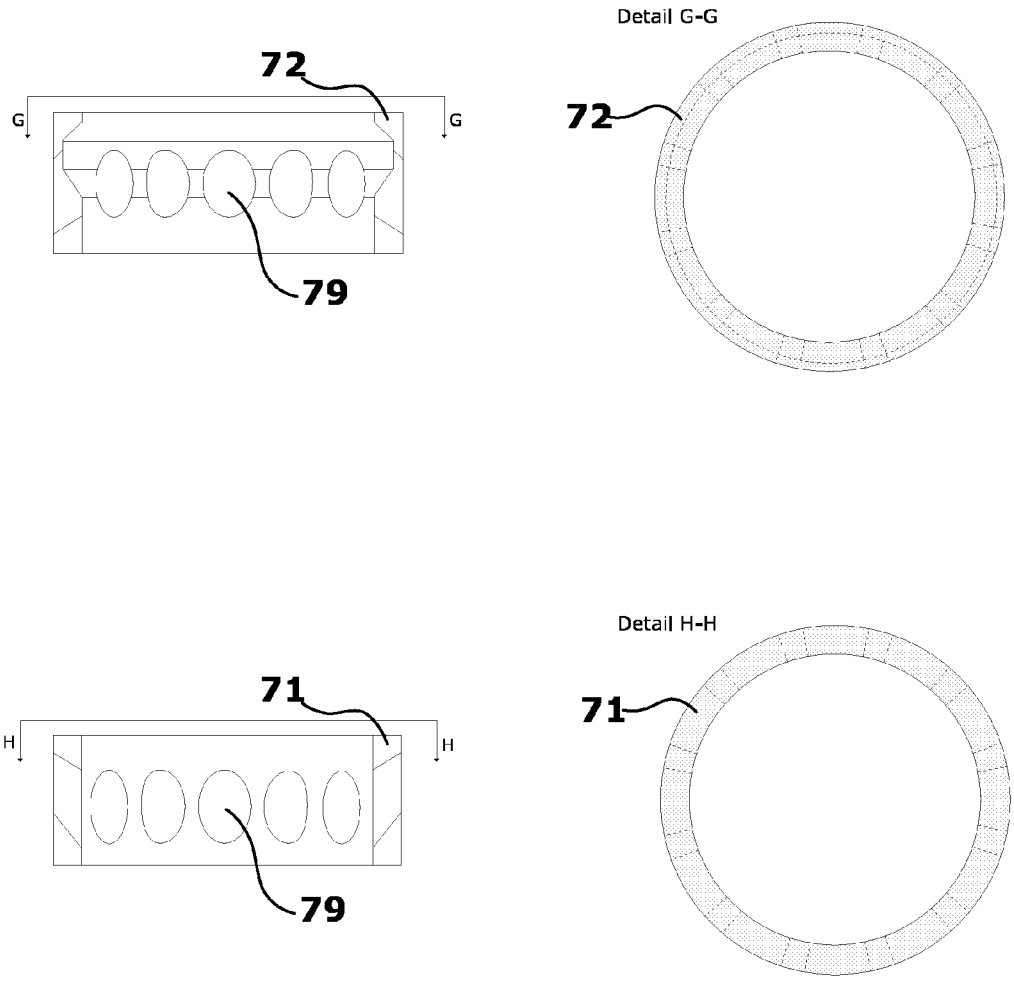
FIG. 8 is a schematic drawing of an embodiment of flow port seat.
Figure 9:
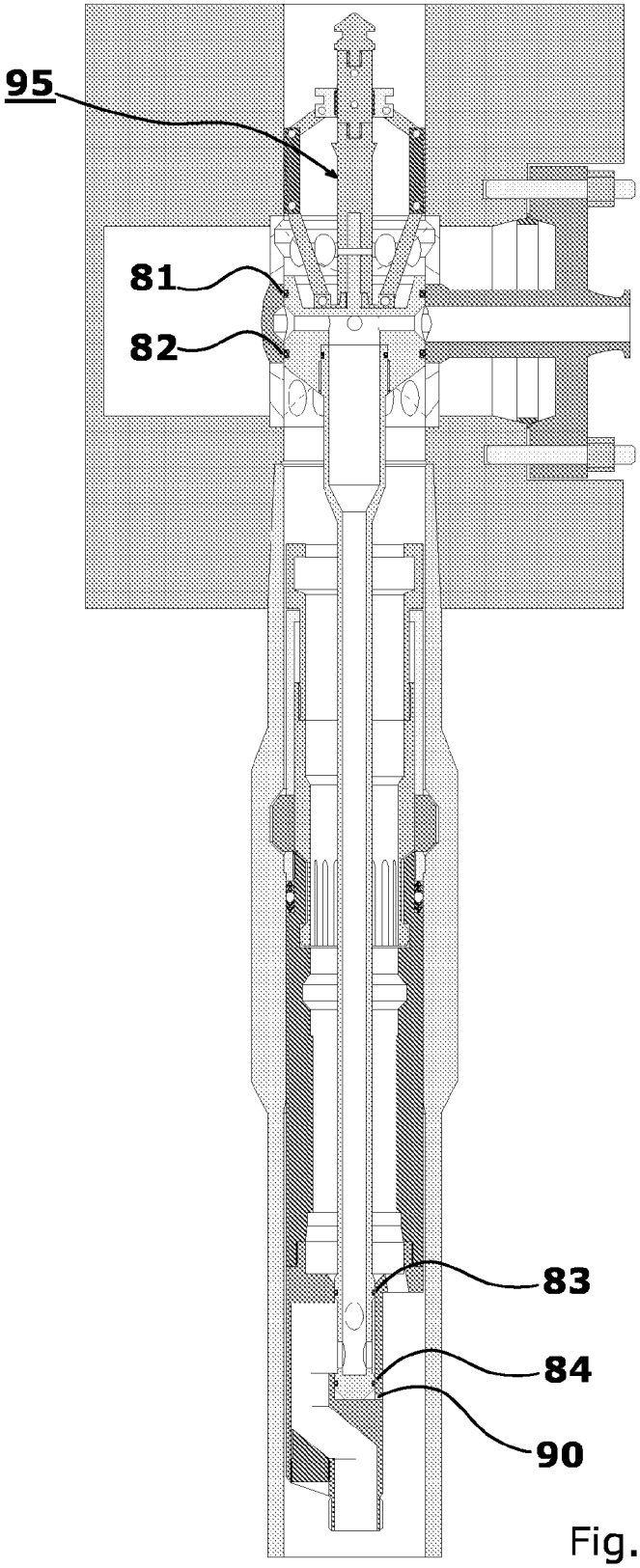
FIG. 9 is a schematic drawing of a housing being equipped with an locking mechanism according to another embodiment.

In FIG. 7 is shown a housing (1) which previously served as a housing for a lower master valve.

In order to use the housing for the establishment of coiled tubing gas lift, the well is plugged off and the valve bonnet is removed.

Furthermore valve gates and valve seats are taken out and the flow port seats (71, 72) are (shown in greater details in FIG. 8) installed in the recesses (9*a*) which were already formed in the housing (for the purpose of supporting the valve seats). The two flow port seats are provided with through-going holes (79) leading from the central flow passage (3) to the cavities (2,4) which earlier served the purpose of housing the gate in its open and closed positions. After the installation of the flow port seats (71, 72), the sealbore bonnet (seen in details in FIG. 5) is installed between the seats. The sealbore bonnet (40) may be secured to the housing (1) by bolts fastened in the same holes as earlier used to fasten the valve bonnet. However, other fastening means may be used.

When installed the seal bore bonnet (40) is sealing off the side entry port (2) from the exterior of the housing (1).

After installation of the seal bore seats (71,72) and the seal bore bonnet (40), a coiled tubing gas lift string is attached to the coiled tubing hanger assembly (12, 13, 14+30) at the coiled tubing connector (31), and the string is deployed into the well with a running tool attached to the coiled tubing hanger (12, 13, 14+30) in a profile (13*c*) (shown in FIG. 3) situated at the top sub (13) (this step is not shown in the illustrations). If the invention is to be used in a well having more than two master valves, the string is deployed into the well through the master valves (normally being situated coaxially above each other).

When the coiled tubing hanger assembly is engaging the tubing hanger lock profile (20), all the weight of the coiled tubing string is set down in the lock profile (20) via a so-called no-go shoulder on the coiled tubing hanger assembly's upper lock mandrel (12). In order to lock the tubing hanger in place, the top sub (13) is then pushed down into the coiled tubing hanger lock assembly (12, 13, 14+30) and the dogs (11) are engaged into the tubing hangers locking profile (20). The running tool is then released from the coiled tubing hanger and pulled out of the well.

The stinger (50) is then connected to the seal bore male part (53) and both are then deployed in the well by holding the stinger assembly locking mechanism (95) and moved down into the well until the lower part of the stinger assembly (50) engages the receptacle in the cross-over tool (30) of the coiled tubing hanger (12, 13, 14+30).

The seal bore male part (53) is then connected to the bonnet seal bore (40) via a locking profile (not shown) in the upper seat (71).

The running tool is then sheared off the stinger and retrieved form the well.

As shown by arrows (A and B) in FIG. 2 two separate flow paths are now established, one of them extending from the annulus surrounding the coiled tubing to the upper part (3*b*) of the central flow passage and the other extending from the exterior of the housing to the interior of the coiled tubing suspended in the well.

In the shown embodiment the fluid tight connection between the internal channel (51) and the external of the housing is achieved by holes/opening (57) leading from inside the stinger (50) to an intermediate channel (58) which is extending to a circumferential void (73) from where the fluid connection is further extended to the external surface of the housing by channel (41) running inside the seal bore bonnet (73).

Figure 10:
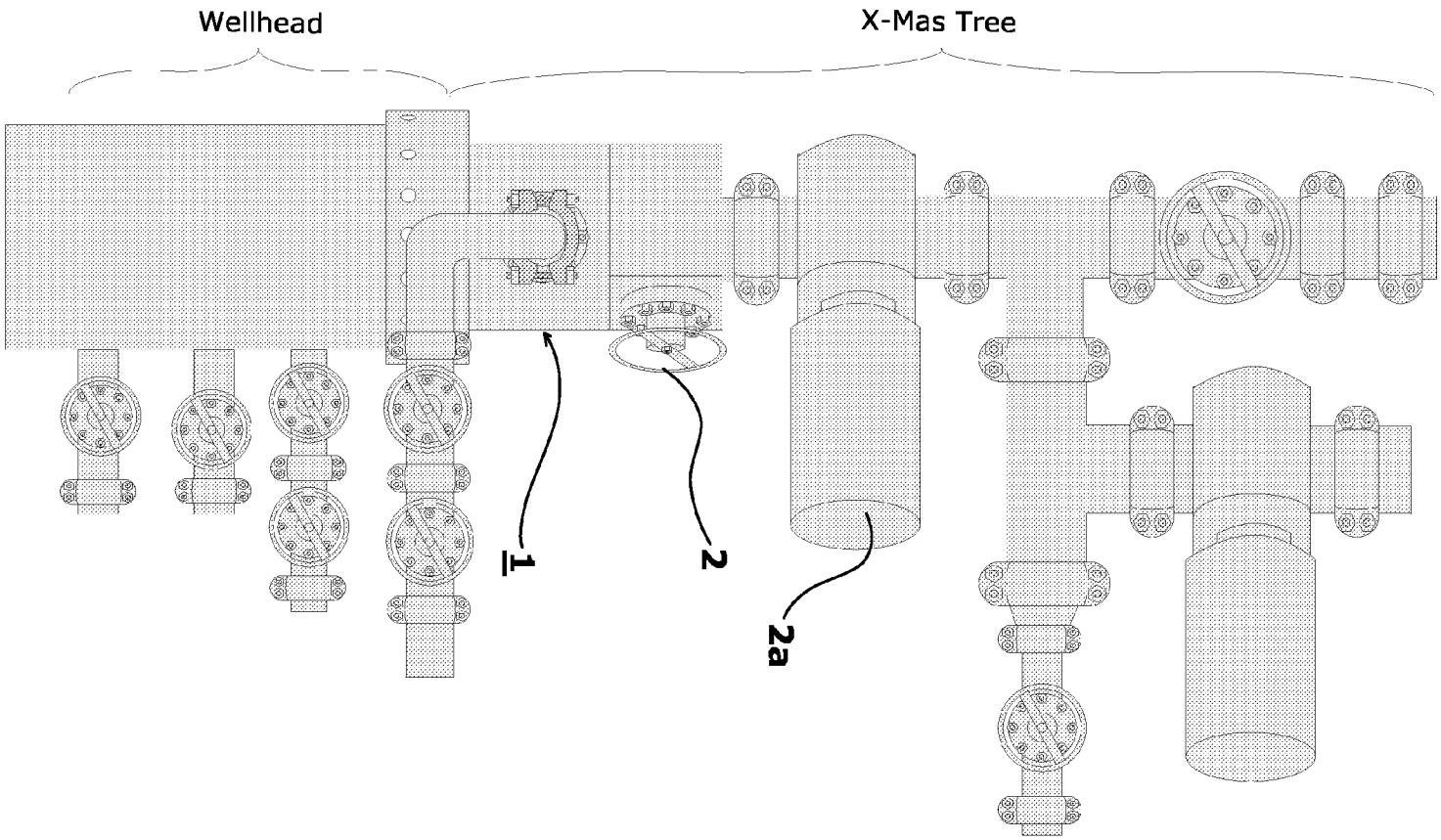
FIG. 10 shows a modified x-mas tree.

FIG. 10 shows a modified x-mas tree being equipped with an embodiment of the invention. The modified x-mas tree, in the shown embodiment, is furthermore equipped with a new master valve (2*a*) located on top of the valve that previously (before the modification) functioned as an upper master valve.

The invention claimed is:

1. An assembly suitable for use in a Christmas tree used with coiled tubing and other wellhead components, said assembly comprising:

a housing having an exterior surface, a first end having an inlet channel and a second end having an outlet channel, said inlet and outlet channels being connected by a central flow passage for providing of fluid communication between a well and said Christmas tree, said first end being connectable to the well, said housing further comprising a side-entry bore for providing fluid communication between said central flow passage and the external of said housing;

a valve bonnet positioned within the side-entry bore that includes a portion that is centered within the central flow passage of the housing;

a hanger tool being positioning in a well tubular below said side-entry bore configured to support a coiled tubing, said hanger tool being provided with two separate fluid passages, a first fluid passage communicating with said coiled tubing and a second fluid passage communicating with an annulus between said coiled tubing and said well tubular, wherein the hanger tool is deployed into the well tubular via the central flow passage of the housing and passes through a center of the portion of the valve bonnet during deployment;

an upper assembly to be inserted through the side-entry bore; and a tubular stinger tool having an upper section and a lower section, the lower section having a first portion adapted to be inserted into the hanger tool and the upper section having a second portion being adapted for connection with said upper assembly to be inserted through said housing, the hanger tool and the tubular stinger tool being mutually adapted such that said first fluid passage is being extended through the tubular stinger to the upper section of said tubular stinger and said second fluid passage is being extended by the annulus created between said tubular stinger tool and said hanger tool, the upper assembly and the upper section of the tubular stinger being mutually adapted such that said first fluid passage is being further extended to the external of said housing and said second fluid passage is being further extended to the second end of the housing.

2. An assembly according to claim 1 wherein said assembly further comprises a second housing for a lower master valve.

3. An assembly according to claim 2 wherein said assembly further comprises a third housing for an upper master valve.

4. An assembly according to claim 2 wherein said second housing includes an inlet channel and an outlet channel, a gate having two faces and a port therein opening into the faces, said gate being reciprocable between an open position and a closed position, said port communicating with said channels when the gate is in the open position.

5. An assembly according to claim 3 wherein said third housing includes an inlet channel and an outlet channel, a gate having two faces and a port therein opening into the faces, said gate reciprocable between an open position and a closed position, said port being communicating with said channels when the gate is in the open position.

6. An assembly according to claim 2 wherein said housing corresponds to a housing previously used as part of a master valve.

7. An assembly according to claim 3 wherein said housing and the housing for the upper master valve are of an identical configuration.

8. An assembly according to claim 3 wherein said central flow passages and said inlet channels and said outlet channels in the upper master valve and the lower master valve are adapted to be in alignment with the bore of the wellhead.

9. An assembly according to claim 8 wherein said hanger tool is adapted to said flow channels and said central flow passages such that the hanger tool can be inserted into the well tubular through said channels and flow passages.

10. An assembly according to claim 8 wherein said tubular stinger tool is adapted to said flow channels and said central flow passages such that the tubular stinger tool can be inserted into the well tubular through said channels and said flow passages.

11. An assembly according to claim 2 wherein said assembly further comprises a housing for an upper master valve.

12. An assembly according to claim 3 wherein said housing corresponds to a housing previously used as part of a master valve.

13. An assembly according to claim 4 wherein said housing corresponds to a housing previously used as part of a master valve.

14. An assembly according to claim 5 wherein said housing corresponds to a housing previously used as part of a master valve.

15. An assembly according to claim 4 wherein said housing and the housing for the upper master valve are of an identical configuration.

16. An assembly according to claim 5 wherein said housing and the housing for the upper master valve are of an identical configuration.

17. An assembly according to claim 6 wherein said housing and the housing for the upper master valve are of an identical configuration.

18. An assembly according to claim 4 wherein said central flow passages and said inlet channels and said outlet channels in the upper master valve and the lower master valve are adapted to be in alignment with the bore of the wellhead.

* * * * *